US005727471A

United States Patent [19]

Iwafune et al.

[11] Patent Number: 5,727,471

[45] Date of Patent: Mar. 17, 1998

[54] OFFSET PRINTING MACHINE

[75] Inventors: Tomoaki Iwafune, Nagano; Koichi Kamoi, Tokyo, both of Japan

[73] Assignees: Nagano Japan Radio Co., Ltd., Nagano-ken; Gradco (Japan) Ltd., Tokyo, both of Japan

[21] Appl. No.: 567,492

[22] Filed: Dec. 5, 1995

[30] Foreign Application Priority Data

Feb. 9, 1995 [JP] Japan ..... 7-046515

[51] Int. Cl.[6] ..... B41F 5/00

[52] U.S. Cl. ..... 101/477; 101/142; 101/216

[58] Field of Search ..... 101/477, 415.1, 101/216, 120, 131, 132, 132.5, 141, 142, 240, 408

[56] References Cited

U.S. PATENT DOCUMENTS

| | | | |
|---|---|---|---|
| 2,374,668 | 5/1945 | Davidson | 101/408 |
| 4,846,057 | 7/1989 | Endo et al. | 101/120 |
| 5,181,466 | 1/1993 | Ono | 101/142 |
| 5,390,597 | 2/1995 | Hashimoto et al. | 101/142 |
| 5,564,337 | 10/1996 | Uehara et al. | 101/408 |
| 5,575,213 | 11/1996 | Kawai et al. | 101/477 |

*Primary Examiner*—Christopher A. Bennett

*Attorney, Agent, or Firm*—Birch, Stewart, Kolasch & Birch, LLP

[57] ABSTRACT

There is provided a plate carrier mechanism A having an endless plate belt 3 hung on between a pair of pulleys 2*p* and 2*q* spaced from each other, and a blanket carrier mechanism B having an endless blanket belt 5 hung on between a pair of pulleys 4*p* and 4*q* spaced from each other, the blanket carrier mechanism B is adapted to be displaceable to a pressure-contacting position Pp or a separating position Pr to the place carrier mechanism A, also, a speed of an outer surface of the plate belt 3 is made greater than that of the blanket belt 5, and the plate carrier mechanism A is of a driving side and the blanket carrier mechanism B is of a driven side, and the plate carrier mechanism A and the blanket carrier mechanism B are connected to each other through a rotation transmitting gear mechanism 6 having a predetermined play which can absorb a difference of the speed of the outer surface of the plate belt 3 and the speed of the outer surface of the blanket belt 5. Thereby a transfer shift between the plate belt and the blanket belt is prevented.

6 Claims, 4 Drawing Sheets

OFFSET PRINTING MACHINE

BACKGROUND OF THE INVENTION

1. Field of the Invention

The present invention relates to an offset printing machine comprising a plate carrier mechanism having an endless plate belt hung on between a pair of pulleys spaced from each other and a blanket carrier mechanism having an endless blanket belt hung on between a pair of pulleys spaced from each other.

2. Description of the Relevant Art

Generally, in an offset printing machine, a plate on which an etching treatment is ensured is charged to a cylindrical printing drum, a humidifying water is spread onto the plate from a liquid supplying mechanism, then an ink is spread, at the time of the printing, and then the ink image fitted onto the plate is once transmitted (off) to the cylindrical blanket drum, and printed (set) onto a printing sheet.

By the way, since the printing drum is used at a cylindrical circumferential surface thereof, diameters of the printing drum and the blanket drum become large, as a size of the plate for use in printing is made large, so that there is caused a large-sizing of the printing machine as a whole.

Therefore, up to now, there has been also proposed in U.S. Pat. No. 5,390,597 an offset printing machine comprising a plate carrier mechanism having an endless plate belt hung on between a pair of pulleys spaced from each other and a blanket carrier mechanism having an endless blanket belt hung on between a pair of pulleys spaced from each other, instead of a plate drum and a blanket drum.

At the time of an etching treatment and a cleaning treatment of the blanket belt, such an offset printing machine must execute the treatments individually at the side of the plate carrier mechanism and the side of the blanket carrier mechanism in a state where the blanket belt is separated from the plate belt. On the contrary, when the ink image is transferred from the plate on the plate belt onto the blanket belt, the blanket belt must be pressure-contacted to the plate belt, and the speed of the outer surface of the plate belt must coincide (synchronize) with that of the blanket belt perfectly.

However, since the conventional offset printing machine has driven the plate carrier mechanism and the blanket carrier mechanism respectively through a predetermined rotation transmitting mechanism (interlocking mechanism) from a driving motor, there is a problem that, when the blanket belt is pressure-contacted to the plate belt, there is caused a transferred shift due to a mechanical error between the plate carrier mechanism and the blanket carrier mechanism and a slip between the belts, etc., accordingly, the quality of printing is degraded.

SUMMARY OF THE INVENTION

As a size of the plate for use in printing is made large, it is, therefore, an object of the present invention to provide an offset printing machine which prevents a transfer shift between a plate belt and a blanket belt, to thereby improve printing quality.

In order to attain this object, there is an offset printing machine comprising a plate carrier mechanism A having an endless plate belt 3 hung on between a pair of pulleys 2P and 2*q* spaced from each other, and a blanket carrier mechanism B having an endless blanket belt 5 hung on between a pair of pulleys 4*p* and 4*q* spaced from each other, in which the blanket carrier mechanism B is adapted to be displaceable to a pressure-contacting position Pp or a separating position Pr to the plate carrier mechanism A, particularly, characterized in that a speed of an outer surface of the plate belt 3 is made greater than that of the blanket belt 5, and the plate carrier mechanism A is of a driving side and the blanket carrier mechanism B is of a driven side, and the plate carrier mechanism A and the blanket carrier mechanism B are connected to each other through a rotation transmitting gear mechanism 6 having a predetermined play which can absorb a difference of the speed of the outer surface of the plate belt 3 and the speed of the outer surface of the blanket belt 5.

In this case, the pulleys 2*p*, 2*q*, 4*p*, 4*q* of the plate carrier mechanism A and the blanket carrier mechanism B are identical in diameter with each other, the plate belt 3 is thicker than the blanket belt 5, and the speed of the outer diameter of the plate belt 3 is made greater than that of the blanket belt. Also, a predetermined play is made by making a distance between tooth portions of gears U, constituting the rotation transmitting gear mechanism 6, greater than a width of the tooth portion T.

On the other hand, each of the pulleys 2*p* and 2*q* of the plate carrier mechanism A is arranged in the horizontal direction, each of the pulleys 4*p* and 4*q* of the blanket carrier mechanism B is arranged in the vertical direction, L-shaped arrangement is realized in such a manner that one end portion of the plate carrier mechanism A pressure-contacts to an upper end portion of the blanket carrier mechanism B, and the blanket carrier mechanism B is adapted to be rotatable with the lower pulley 4*q* as a fulcrum. Further, the rotation transmitting gear mechanism 6 transmits a rotation of the pulley 2*q* of the plate carrier mechanism A to the lower pulley 4*q* of the blanket carrier mechanism B. Moreover, the rotation transmitting mechanism 6 comprises a driving gear 22 rotating together with pulley 2*q* of the plate carrier mechanism A, a driven gear 23 rotating together with the pulley 4*q* of the blanket carrier mechanism B, and a plurality of intermediate gears 24, 25 arranged between the driving gear 22 and the driven gear 23.

Thereby, if the blanket carrier mechanism B is displaced to a separating position Pr to the plate carrier mechanism A, the blanket belt 5 is separated from the plate belt 3, and a rotation of the pulley 2*q* of the plate carrier mechanism A which is of a driving side is transmitted to the pulley 4*q* of the blanket carrier mechanism B through the rotation transmitting gear mechanism 6. As a result, the pulley 2*q* of the place carrier mechanism A is driven by a predetermined rotating driving portion, the plate belt 3 is moved and the pulley 4*q* of the blanket carrier mechanism B is driven by a torque transmitted from the rotation transmitting gear mechanism 6, so that the blanket belt 5 is moved.

On the other hand, if the blanket carrier mechanism B is displaced to a pressure-contacting position Pp to the plate carrier mechanism A, the blanket belt 5 is pressure-contacted to the plate belt 3, and the speed of the outer surface of the blanket belt 5 coincides with the speed of the outer surface of the plate belt 3 due to a friction contact between the plate belt 3 and the blanket belt 5. In this case, since the speed of the outer surface the plate belt 3 is greater than that of the blanket belt 5, a moving speed of the blanket belt 5 following the plate belt 3 is greater than a moving speed thereof based on a torque transmitted from the plate carrier mechanism A through the rotation transmitting gear mechanism 6, however, this speed difference is absorbed by a predetermined play between gears of the rotation transmitting gear mechanism 6. As a result, an influence from the rotation transmitting gear mechanism 6 to the blanket belt 5 is eliminated, and the speed of the outer surface of the blanket belt 5 coincides with that of the plate belt 3, and then the transfer shift between the plate belt 3 and the blanket belt 5 is prevented from occurring.

DETAILED DESCRIPTION OF THE PREFERRED EMBODIMENTS

A preferred embodiment according to the present invention will be described hereinafter with reference to the drawings.

At first, an external appearance construction of an offset printing machine 1 according to this embodiment will be described with reference to FIG. 6.

Figure 6:
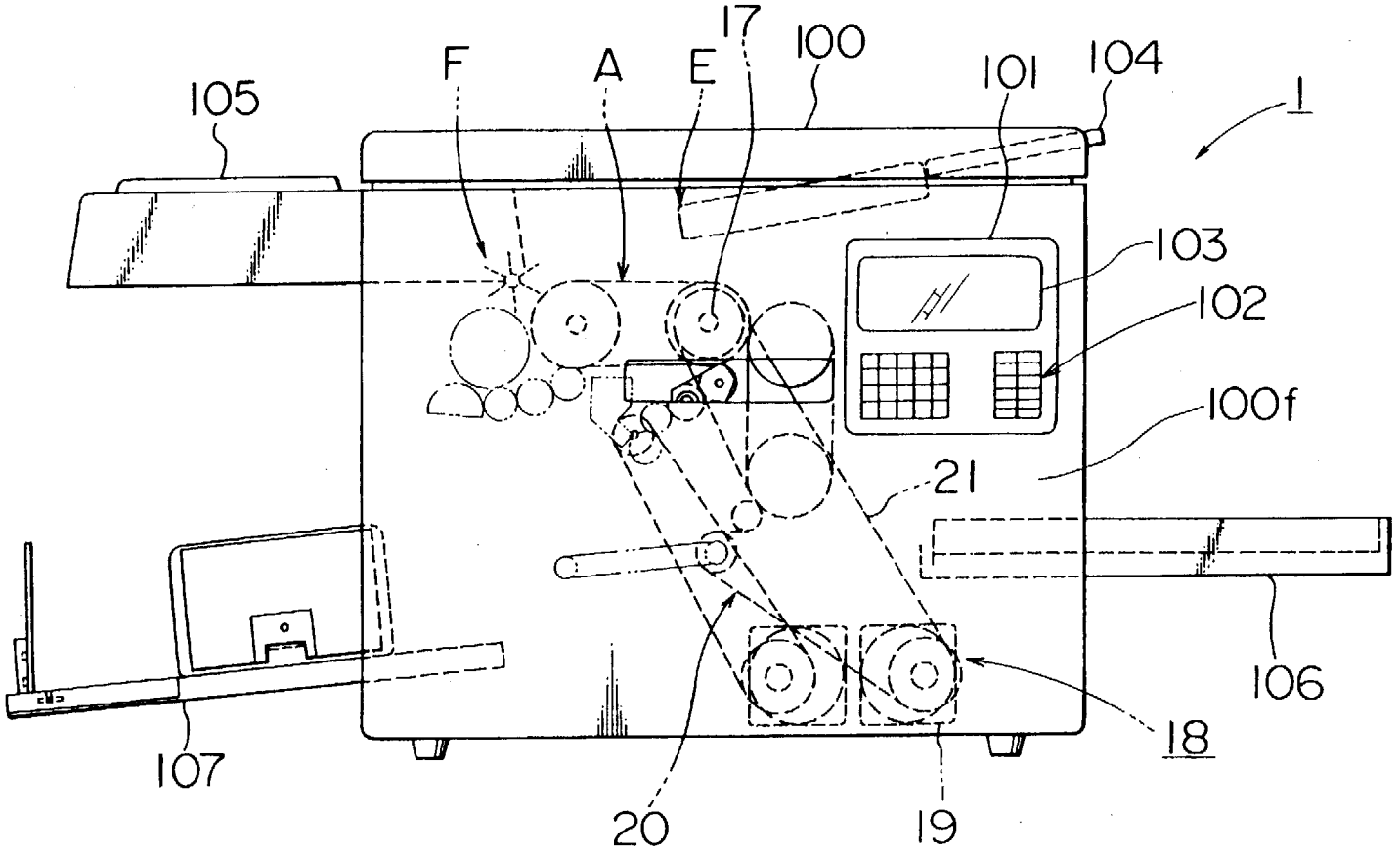
FIG. 6 is an external appearance side view of the same offset printing machine.

FIG. 6 shows an external appearance side view of the offset printing machine 1. Reference numeral 100 denotes a printing machine main body, in which an operating panel 101 having an operating key 102 and a display 103 is attached to a case surface 100*f*. Also, the printing machine main body 100 has a plate tray 104 of an automatic plate mechanism E for supplying automatically a plates S at a rear portion thereof, and a plate collecting tray 105 of an automatic plate discharging mechanism F for discharging automatically the plates S at a fore portion thereof. Furthermore, the printing machine main body 100 has a printing sheet tray 106 for supplying printing sheets at below the rear portion thereof, and a printing sheet collecting tray 107 for collecting the printing sheets already printed below the fore portion thereof.

Next, the internal construction including the main part of the offset printing machine 1 according to this embodiment will be described with reference to FIGS. 1 to 5.

Figure 5:
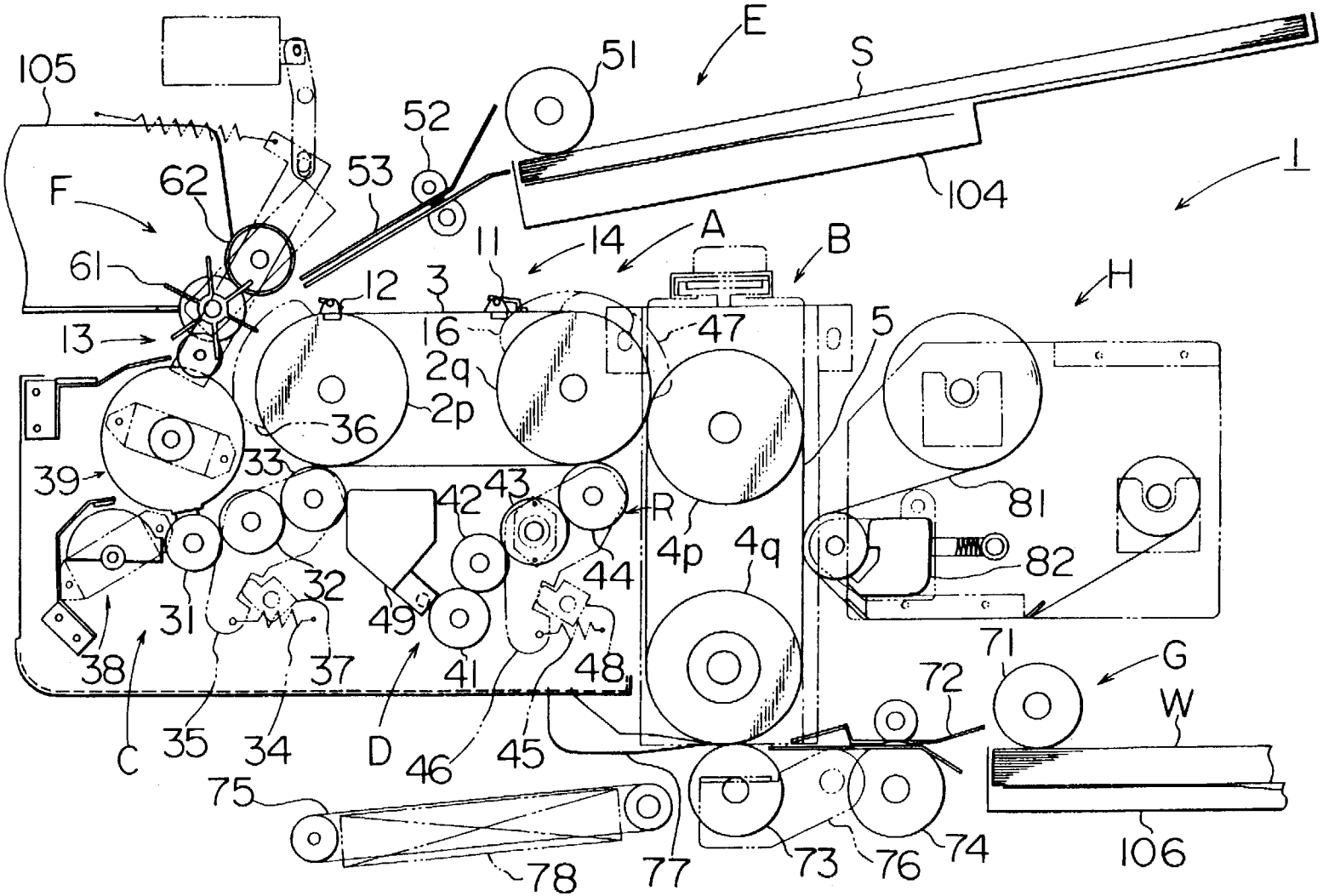
FIG. 5 is an internal constructional view of the same offset printing machine.

FIG. 5, symbol A denotes a plate carrier mechanism, which comprises a pair of pulleys (gears) 2*p*, 2*q* spaced apart from each other in the horizontal direction, and an endless plate belt 3 hung on between respective pulleys 2*p* and 2*q*. The plate belt 3 is a timing belt. Then, the plate carrier mechanism A comprises a plate clamping mechanism 14 having a fore clamping mechanism 11 and a rear clamping mechanism 12 attached to the plate belt 3, and an operating mechanism 13 arranged so as to oppose to the plate belt 3.

Figure 1:
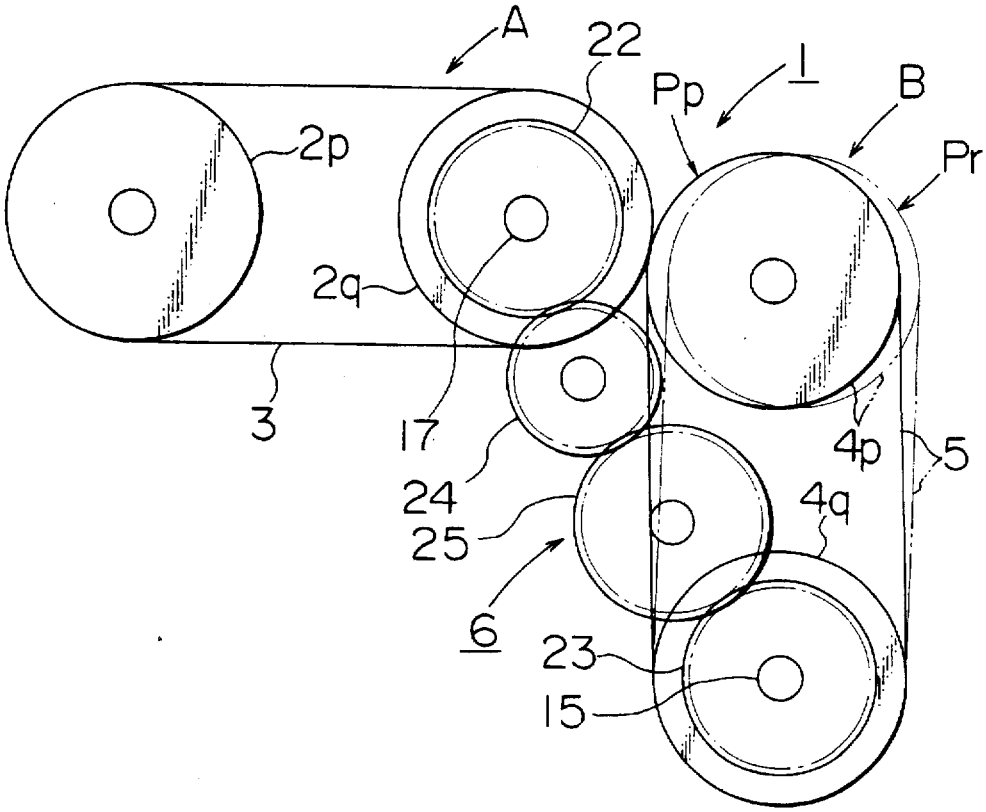
FIG. 1 is a diagrammatic constitutional view of a main part of an offset printing machine according to the present invention.

Also, symbol B denotes a blanket carrier mechanism, which comprises a pair of pulleys (gears) 4*p*, 4*q* spaced apart from each other in the vertical direction, and an endless blanket belt 5 hung on between respective pulleys 4*p* and 4*q*. The blanket belt 5 is a timing belt. In this case, the plate carrier mechanism A and the blanket carrier mechanism B are arranged in L-shaped manner such that an upper end portion of the blanket carrier mechanism B is pressure-contacted to one end portion of the plate carrier mechanism A. Also, the blanket carrier mechanism B is adapted to be displaceable rotatably with a shaft 15 of the lower pulley 4*q* positioned as a fulcrum, as shown in FIG. 1. Thereby, the blanket carrier mechanism B turns out to be displaceable selectively to a pressure-contacting position Pp shown by a solid line, at which the blanket belt 5 pressure-contacts to the plate belt 3, or a separating position Pr from which the blanket belt 5 is separated. Usually, the blanket carrier mechanism B is urged in the pressure-contacting direction at the pressure-contacting position Pp, and when the fore clamping mechanism 11 and the rear clamping mechanism 12 pass therethrough, the blanket carrier mechanism B is pressed by a cam 16 following the rotation of the pulley 2*q* to thereby be separated from the plate belt 3. Incidentally, the blanket carrier mechanism B can be locked by a locking mechanism (not shown) at a position which is separated from the plate belt 3.

Moreover, the plate carrier mechanism A and the blanket carrier mechanism B are constructed as described below according to the present invention.

Figure 3:
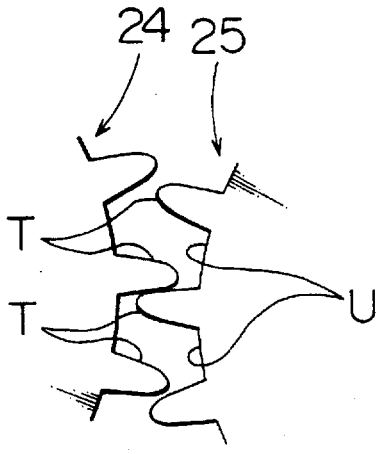
FIG. 3 is a principle-explanatory view showing an engaging state of intermediate gears of a rotation transmitting gear mechanism disposed on the same offset printing machine.
Figure 4:
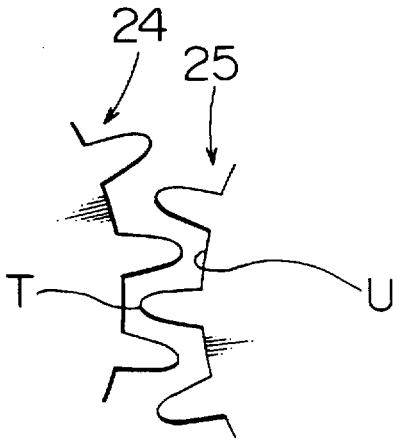
FIG. 4 is a principle-explanatory view showing a disengaging state of intermediate gears of the rotation transmitting gear mechanism disposed on the same offset printing machine.

At first, the plate carrier mechanism A turns out to be of a driven side, a shaft 17 of the pulley 2*q* is driven by the rotating and driving portion 18 shown in FIG. 6. Moreover, the rotating and driving portion 18 comprises a rotation transmitting portion 20 using a servo motor 19 and a timing belt 21. On the other hand, the plate carrier mechanism A and the blanket carrier mechanism B are connected with each other through the rotation transmitting gear mechanism 6. That is, a driving gear 22 rotating together with the pulley 2*q* is attached to the shaft 17 of the pulley 2*q* of the plate carrier mechanism A, on the other hand, a driven gear 23 rotating together with the pulley 4*q*is attached to the shaft 15 of the lower pulley 4*q* of the blanket carrier mechanism B, and a first intermediate gear 24 and a second intermediate gear 25 are meshed in series between the driving gear 22 and the driven gear 23, thereby a rotation of the pulley 2*q* is transmitted to the pulley 4*q*through the rotation transmitting gear mechanism 6. Then, on this occasion, optional gears, for example, the first intermediate gear 24 and the second intermediate gear 25 are formed in such a manner that a distance between the tooth portions U turns out to be greater than a width of the tooth portions T to thereby cause a predetermined play, as shown in FIGS. 3 and 4.

Figure 2:
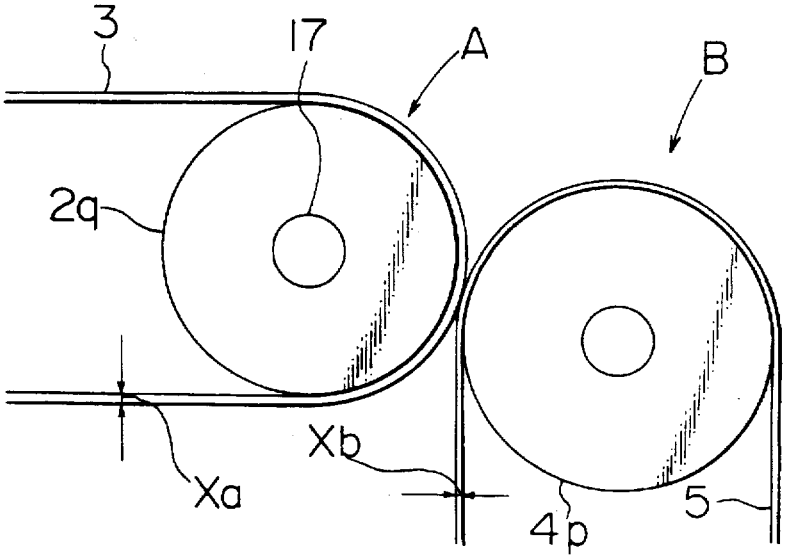
FIG. 2 is a principle-explanatory view showing a relation between a plate belt and a blanket belt disposed on the same offset principle machine.

Also, a speed of an outer surface of the plate belt 3 is made greater than that of the blanket belt 5. To be concrete, the pulleys 2*p*, 2*q* of the plate carrier mechanism A is made identical in diameter with the pulleys 4*p*, 4*q* of the blanket carrier mechanism B, and as shown in FIG. 2, a thickness Xa of the plate belt 3 is made greater than a thickness Xb of the blanket belt 5, that is, a relation Xa>Xb is satisfied, thereby the speed of the outer surface of the plate belt 3 is made greater than that of the blanket belt 5.

Therefore, according to the plate carrier mechanism A and the blanket carrier mechanism B, the blanket carrier mechanism B is displaced at the separating position Pr to the plate carrier mechanism A, so that the blanket belt 5 is separated from the plate belt 3. As a result, a rotation of the pulley 2*q* of the plate carrier mechanism A which is of a driving side is transmitted to the pulley 4*q* of the blanket carrier mechanism B through the rotation transmitting gear mechanism 6. Therefore, the first intermediate gear 24 and the second intermediate gear 25 are engaged with each other perfectly as shown in FIG. 3. Thereby, the pulley 2*q* of the plate carrier mechanism A is driven by the rotating and driving mechanism 18, the plate belt 3 is moved, then the pulley 4*q* of the blanket carrier mechanism B is driven by the torque transmitted from the rotation transmitting gear mechanism 6, so that the blanket belt 5 is moved. In this case, the etching treatment is carried out at a side of the plate carrier mechanism A described later. Also, the cleaning treatment of the blanket belt 5 is carried out at a side of the blanket carrier mechanism B.

On the other hand, if the blanket carrier mechanism B is displaced to the pressure-contacting position Pp to the plate carrier mechanism A, the blanket belt 5 pressure-contacts to the plate belt 3, so that the speed of the outer surface of the blanket belt 5 coincides with that of the plate belt 3 due to the friction contact. In this case, the speed of the outer surface of the plate belt 3 is made greater than that of the blanket belt 5, so that the moving speed of the blanket belt 5 following the plate belt 3 turns out to be greater than the moving speed thereof based on the torque transmitted through the rotation transmitting gear mechanism 6 from the plate carrier mechanism A. However, the speed difference is absorbed by the predetermined play between the gears of the rotation transmitting gear mechanism 6. That is, the first intermediate gear 24 and the second intermediate gear 25 are disengaged with each other as shown in FIG. 4. As a result, an influence from the rotation transmitting gear mechanism 6 to the blanket belt 5 is eliminated, so that the speed of the outer surface of the blanket belt 5 coincides perfectly with that of the plate belt 3, and the transfer shift between the plate belt 3 and the blanket belt 5 is prevented from occurring, so that the quality of the printing is improved.

Symbol C denotes a treating liquid supplying mechanism, which comprises a first roller 31, a second roller 32 and a treating liquid spreading roller 33 which contact in order. In this case, the treating liquid spreading roller 33 is supported by a rotating plate 35 urged by a spring 34 to thereby pressure-contacts to a surface of the plate belt 3, so that when the fore clamping mechanism 11 and the rear clamping mechanism 12 pass therethrough, the treating liquid spreading roller 33 is pressed by a cam 36 following the rotation of the pulley 2*p* to thereby be separated from the plate belt 3, and when it is not used, it is locked by a locking mechanism 37 at a position which is separated from the plate belt 3. An etching liquid supplying portion 38 supplying an etching liquid to the first roller 31 and a humidifying water supplying portion 39 supplying a humidifying water are arranged in the vicinity of the first roller 31, to thereby be adapted to supply the etching liquid or the humidifying water selectively to the first roller 31.

Also, symbol D denotes an ink supplying apparatus, which comprises an ink kneading roller mechanism R having a plurality of ink rollers contacting in turn, that is, a first roller 41, a second roller 42, a third roller (laterally swinging roller) 43 and an ink spreading roller 44. In this case, the ink spreading roller 44 is supported by a rotating plate 46 urged by a spring 45 to thereby pressure-contact to the surface of the plate belt 3, so that when the fore clamping mechanism 11 and the rear clamping mechanism 12 pass therethrough, the ink spreading roller 44 is pressed by a cam 47 following the rotation of the pulley 2*q* to thereby be separated from the plate belt 3, and when it is not used, it is locked by a locking mechanism 48 at a position which is separated from the plate belt 3. On the other hand, the ink is supplied to the first roller 41 from an ink container 49.

Furthermore, symbol E denotes an automatic plate supplying mechanism, which comprises a plate tray 104 for containing a plurality of the plates S, a separating roller 51 for separating and taking out the plates S one be one from the plate tray 104, a plate supplying mechanism 52 for transporting the taken out plates S from the plate tray 104, and a guiding portion 53 for guiding the plates S, and having a function of supplying automatically the plates S to the plate carrying mechanism A.

On the other hand, symbol F denotes an automatic plate discharging mechanism, which comprises a paddle roller 61 displacing in a side of the plate belt 3 at the time of the discharging, for picking up a fore portion of the plate S disengaged from the fore clamping mechanism 21, a plate discharging mechanism 62 transmitting and discharging the picked up plates S, and a plate collecting tray 105 for collecting the discharged plates S, and having a function of discharging the plates S automatically from the plate carrier mechanism A.

Also, symbol G denotes a printing mechanism, which comprises a printing sheet tray 106 for containing a plurality of printing sheets W . . . , a separating roller 71 for separating and taking out the printing sheets W one by one from the printing sheet tray 106, a guiding portion 72 for guiding the printing sheets W taking out from the printing sheet tray 106, a pressure-contacting roller 73 being capable of pressure-contacting to the surface of the blanket belt 5, a sheet supplying roller mechanism 74 for sending the printing sheets W to between the pressure-contacting roller 73 and the blanket belt 5, and a transferring belt mechanism 75 for sending to a printing sheet collecting tray 107 the printing sheets W sent from between the pressure-contacting roller 73 and the blanket belt 5. Moreover, the pressure-contacting roller 73 is supported so as to be displaceable by a supporting portion 76, and is pressure-contacted to and is separated from the blanket belt 5. Also, reference numeral 77 denotes a tearing off nozzle for jetting an air to tear off the printing sheets W from the blanket belt 5, and 78 is a suction unit for attracting the printing sheets W to the transferring belt mechanism 75.

On the other hand, symbol H denotes a cleaning mechanism, which removes a residue ink on the blanket belt 5 by a cleaning sheet 81 such as a cloth supplied from a roll and a cleaning liquid supplied from a cleaning liquid supplying portion 82.

Next, an operation of such an offset printing mechanism 1 as a whole will be described with reference to FIG. 5.

At first, the plates S . . . are set on the plate tray 21. In this case, the printing sheet on which a toner is printed by a laser printer can be used for the plate S. On the other hand, the plates S set onto the plate tray 21 are charged automatically onto the surface of the plate belt 13 by an automatic plate supplying mechanism E. That is, at the time of the charging, after a fore portion of the plate S is clamped by the fore clamping mechanism 14, the plate S is charged onto the plate belt 3 and a rear portion of the plate S is clamped by the rear clamping mechanism 12. Incidentally, at the time of the charging, an etching treatment is carried out simultaneously. In this case, the ink supplying mechanism D and the blanket belt 5 are separated from the plate belt 3. Also, the treating liquid supplying mechanism C is pressure-contacted to the plate belt 3, and the etching liquid supplied from the etching liquid supplying portion 38 is spread to the plate S charged onto the plate belt 3. Thereby, contamination and dusts and the like of the plate S are removed, and hydrophilic property (hygroscopic property) is raised.

On one hand, in the printing step, the ink supplying mechanism D, the blanket belt 5 and the treating liquid supplying mechanism C are pressure-contacted to the plate belt 3. Also, the humidifying water is set so as to be supplied to the plate belt 3 from the humidifying water supplying portion 39. Thereby, if the plate S is advanced from a stand-by position, the humidifying water is spread to the plate S charged onto the plate belt 3, further, the ink is spread from the ink supplying mechanism D. On this occasion, the ink is fitted only to the image portion of the plate S. Then, the ink image on the plate S is transferred to the surface of the blanket belt 5. On the other hand, in the printing mechanism G, the printing sheet W is automatically fed to between the blanket belt 5 and the pressure-contacting roller 54, and the ink image of the blanket belt 5 is transferred to the printing sheet W. Such a printing step is repeated by the number of the printing sheets.

Also, the plate S charged to the plate belt 13 is discharged and collected to the plate collecting tray 105 when the printing of the plate S is finished. On the other hand, the residue ink of the blanket belt 5 is removed by the cleaning mechanism H.

As described above, the embodiment has been described in detail, however, the present invention is not limited to such an embodiment. For example, the rotation transmitting gear mechanism 6 is adapted to transmit to the pulley 4*q* the rotation of the pulley 2*q* of the plate carrier mechanism A which is of a driving side. However, the pulley 4*q* may be directly driven by the rotating and driving portion 18. Furthermore, in detail construction, shape, number, material and the like, it may be changed on occasion without departing from the spirit and the scope of the present invention.

We claim:

1. As offset printing machine comprising a plate carrier mechanism having an endless plate belt hung on between a first pair of pulleys spaced from each other, and a blanket carrier mechanism having an endless blanket belt hung on between a second pair of pulleys spaced from each other, said second pair of pulleys having a lower pulley in which the blanket carrier mechanism is displaceable between a pressure-contacting position and a separating position by a cam, characterized in that the speed of an outer surface of the plate belt is made greater than an outer surface of the blanket belt, and the plate carrier mechanism is driven by a driving portion and the blanket carrier mechanism is driven by said blanket carrier mechanism, and the plate carrier mechanism and the blanket carrier mechanism are connected to each other through a rotation transmitting gear mechanism having a predetermined play which can absorb a difference of the speed of the outer surface of the plate belt and the speed of the outer surface of the blanket belt.

2. The offset printing machine according to claim 1, wherein the first pair of pulleys of the plate carrier mechanism and the second pair of pulleys of the blanket carrier mechanism are identical in diameter with each other, and the plate belt is thicker than the blanket belt.

3. The offset printing machine according to claim 1, wherein predetermined play is made by making a distance between tooth portions of gears of said rotation transmitting gear mechanism greater than a width of the tooth portions.

4. The offset printing machine according to claim 1, wherein each of the pulleys of the plate carrier mechanism is arranged in the horizontal direction, each of the pulleys of the blanket carrier mechanism is arranged in the vertical direction, whereby the horizontal and vertical pulley positions form a L-shaped arrangement where one end portion of the plate carrier mechanism pressure-contacts to an upper end portion of the blanket carrier, and the blanket carrier mechanism is adapted to be rotatable with said lower pulley functioning as a fulcrum.

5. The offset printing machine according to claim 1 or 4, wherein the rotation transmitting gear mechanism transmits a rotation of a pulley of the plate carrier mechanism to said lower pulley of the blanket carrier mechanism.

6. The offset printing machine according to claim 5, wherein the rotation transmitting mechanism comprises a driving gear rotating together with a pulley of the plate carrier mechanism, a driven gear rotating together with a pulley of the blanket carrier mechanism, and a plurality of intermediate gears arranged between the driving gear and the driven gear.

* * * * *